US005730209A

United States Patent [19]

Sunder et al.

[11] Patent Number: 5,730,209

[45] Date of Patent: Mar. 24, 1998

[54] DEFROST AND LIQUID DISTRIBUTION FOR PLATE-FIN HEAT EXCHANGERS

[75] Inventors: Swaminathan Sunder; Patrick Alan Houghton, both of Allentown; Frank Jude Riska, Palmerton; William Robert Licht, Allentown, all of Pa.; Melvyn Roy Collyer, Surrey, England

[73] Assignee: Air Products and Chemicals, Inc., Allentown, Pa.

[21] Appl. No.: 430,646

[22] Filed: Apr. 28, 1995

[51] Int. Cl.[6] ..... F25J 3/04

[52] U.S. Cl. ..... 165/95; 165/139; 165/166

[58] Field of Search ..... 62/303, 903; 165/95, 165/139, 166

[56] References Cited

U.S. PATENT DOCUMENTS

| | | | |
|---|---|---|---|
| Re. 33,026 | 8/1989 | Petit et al. | 62/36 |
| 3,992,168 | 11/1976 | Toyama et al. | 62/903 X |
| 5,122,174 | 6/1992 | Sunder et al. | 62/24 |

*Primary Examiner*—Allen J. Flanigan
*Attorney, Agent, or Firm*—Willard Jones, II

[57] ABSTRACT

Method and apparatus for moving a conditioning fluid, e.g. defrost gas, through a plate fin type heat exchanger having open-ended passages containing easyway or hardway finning. Each group of open-ended passages is provided with means to introduce the fluid into the passages at a location to achieve maximum contact of the fluid with each open-ended passage. A downflow reboiler according to the invention can be readily conditioned (e.g. defrosted).

21 Claims, 7 Drawing Sheets

DEFROST AND LIQUID DISTRIBUTION FOR PLATE-FIN HEAT EXCHANGERS

TECHNICAL FIELD OF THE INVENTION

The present invention pertains to introducing conditioning fluids, e.g. defrost fluids, into plate-fin type heat exchangers.

BACKGROUND OF THE INVENTION

Plate-fin heat exchangers are used in a variety of processes for heating or cooling fluids by heat exchange. The fluids can flow in counter current or co-current flow and can be gases, liquids or mixtures thereof.

In a large number of plate-fin heat exchangers, it is advantageous to have open-ended passages for some of the streams which are subject to heat exchange. If a plate-fin heat exchanger is used in cryogenic service, it is necessary to add additional equipment in order to provide means for conditioning the heat exchanger prior to the heat exchanger being put into service, even when the heat exchangers are located completely inside an enclosed shell such as inside a column used in an air separation plant wherein the constituents such as oxygen, nitrogen, and argon may be separated from the air. In an air separation plant, it is generally necessary to defrost the heat exchanger as part of the whole plant prior to start up as well as periodically during the lifetime of operation in order to maintain efficiency.

Plate-fin type heat exchangers are used as downflow reboilers, such as shown and described in U.S. Pat. No. 5,122,174, which have closed top ends for the boiling stream which is generally pure or impure oxygen. The liquid oxygen (LOX) is fed via a two-stage distribution device consisting of injection tubes or a slotted bar used as the first stage, and a hardway fin used as a second stage of distribution. The top end of the heat exchanger which incorporates the liquid oxygen stream distributor is closed and allows positive flow for defrost purposes prior to normal operation. However, this device is mechanically complex and has a high pressure drop which adds cost to the reboiler and the overall system.

U.S. Pat. No. Re. 33,026 discloses and claims downflow reboilers wherein the liquid oxygen is fed through a set of orifices as the primary stage of distribution which accounts for all of the distribution pressure drop, and then through hardway fins as a secondary stage which, according to patentees adds no further pressure drop. A device of this type is also mechanically complex and has a high total pressure drop which would add to the cost of the reboiler and the overall air separation system. Such a device would be difficult to condition (defrost).

For the conventional thermosiphon type plate-fin heat exchanger used in cryogenic service, it is common to add external baffles which will force positive flow of conditioning fluid, e.g. defrost fluid fed via the column shell. This results in an increase in the resistance to the external flow which during normal operation is detrimental to the overall operation of the process. If external baffles are applied to a downflow reboiler to force defrost fluid through it, this would also be detrimental to the overall operation.

Hardway fins, e.g. fins with perforations disposed transverse to the flow of fluid in the heat exchanger passage, have been used in closed-end plate fin heat exchangers as a means of distributing liquid uniformly across the width of the passages. Hardway fins are described in detail in U.S. Pat. No. 5,122,174 the specification of which is incorporated herein by reference. This method is not readily suitable for an open-ended plate fin heat exchanger when the heat exchanger has to be conditioned, e.g., defrosted when used in a cryogenic application. The additional pressure drop in the hardway fin introduced for liquid distribution uniformity only exacerbates the problem during defrosting in the manner described above.

SUMMARY OF THE INVENTION

The present invention pertains to a plate-fin heat exchanger which, in one embodiment, has at least one set (group) of stream passages that are open at both ends to a secondary container into which the heat exchanger would be placed. The inlet to the first stream may have an open header to guide the incoming stream which, under normal operation, may enter at the top and leave at the bottom of the heat exchanger which is generally oriented in a vertical direction. Alternatively, the stream may enter in the bottom and exit at the top as in a thermosiphon type heat exchanger. The heat exchanger will have one or more second set (group) of passages with headers and piping to feed and remove a stream or streams for heat exchange contact with the first stream.

Heat exchangers according to the present invention can have a combination of hardway finning (disposed transverse to the direction of flow of the stream) and easyway finning (disposed parallel to the direction of flow of the stream) inside each of the open-ended passages. Prior to normal operation conditioning fluid is introduced into each set or group of these passages independently at a location between the top and bottom of the heat exchange passages. In the case where hardway and easyway finning are used, the conditioning fluid is introduced into each group of passages between the hardway and easyway finning or at a location between a first and second end of the hardway finning portion of the passages. Placement of the entry of the conditioning fluid is selected to ensure adequate flow of conditioning fluid to the various locations of the group of passages concerned.

DETAILED DESCRIPTION OF THE INVENTION

Figure 1:
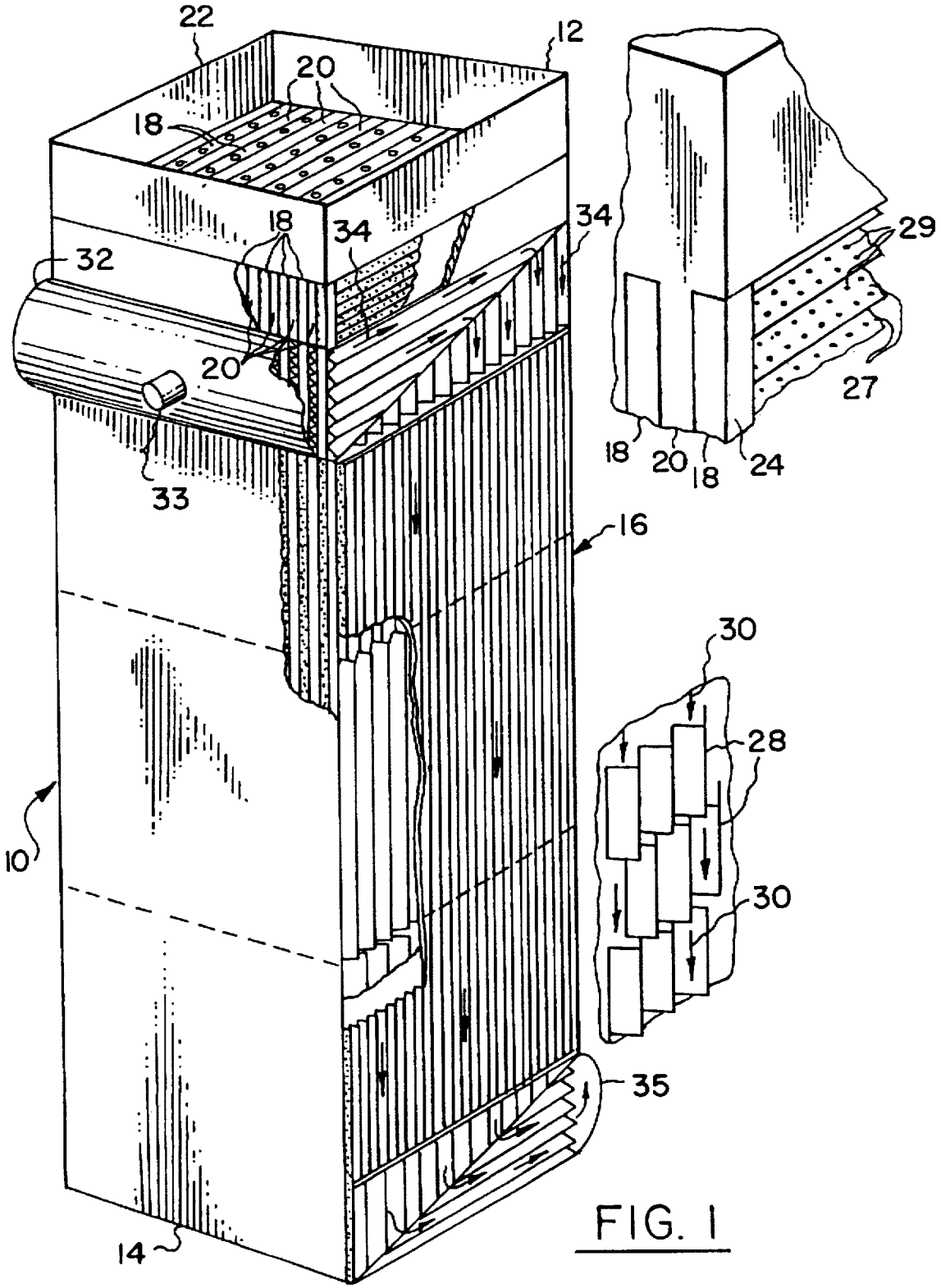
FIG. 1 is an isometric drawing illustrating one embodiment of the apparatus and method of the present invention, including enlarged fragmentary details of the hardway and easyway finning.

Referring to FIG. 1, numeral 10, illustrates a heat exchanger having a first end 12 and a second end 14. The body 16 of the heat exchanger 10 has a generally parallelpipedal shape and includes both a first group of passages 18 and a second group of passages 20, the groups of passages 18 and 20 adapted to receive different fluids with the passages in each group being placed alternately to one another. For example, passages 18 are adapted to receive a fluid which is placed in a top enclosure or open top pan-like device 22. Passages 18 are open at the top or first end 12 and bottom or second end 14 of body 16. In actual construction a side bar 24 would close the vertical ends of each passage 18. A portion of a typical side bar is shown as 24 in the enlarged section to the right in FIG. 1. Passages 18 have a top portion fitted with horizontally placed fins 27 (shown in the enlarged section) containing perforations 29. This type of fin is called hardway finning and promotes even distribution of fluid introduced through pan-like section 22 into the passages 18. Other types of hardway fins suitable for use in the invention are serrated and perforated herringbone type (wavy fins). Notwithstanding the type of finning used in hardway finning section 27, this finning would best be designed such that the frictional pressure drop of the fluid (liquid) flowing through section 27 is in the range of 0.25 to 10 times and, preferably, in the range of 1 to 5 times the flow length of the finning when the frictional pressure drop is expressed as inches of liquid. The bottom section of passages 18 include vertically displaced fins 28 (in the enlarged section) which are called easy-way fins, which receive fluid flow in the direction of the arrows 30. The fins 28 shown in FIG. 1 are serrated, however perforated, plain, herringbone type or other similar type fins can be used. In the embodiment of FIG. 1, fluid introduced into the pan-like device 22 flows downwardly through passages 18 in the heat exchanger 10 and exits by falling freely through the bottom end 14 of heat exchanger 10 and is collected for other parts of the process by equipment that is known in the art and consequently not shown. A second working fluid is introduced to passages 20 of heat exchanger 10 via conduit 33 and header 32 and is conducted as shown by arrows 34 through a horizontal/vertical distributor and is collected in a bottom header 35. A device such as shown in FIG. 1 could be used as a downflow reboiler wherein a boiling or evaporating liquid is introduced into the tank-like device 22 to flow down through passages 18. A gas to be condensed is introduced into passages 20 via header 32 where it is heat exchanged against liquid flowing in passages 18 and is condensed and removed by a header 35 with both fluids flowing in a generally parallel or co-current direction.

In some applications it may be preferable to filter the stream entering passages 18. A filter can be incorporated into pan-like device 22.

In using the heat exchanger of FIG. 1, for example, in cryogenic service, it becomes necessary to introduce a fluid such as a defrosting fluid into the heat exchanger prior to putting the heat exchanger in service. Inclusion of hardway finning in the heat exchanger which serves to distribute liquid during normal operation, presents a problem during defrost because of the hardway finning causing a high resistance to gas flow. The present invention solves this problem in relation to a heat exchanger used as a downflow reboiler such as shown in FIG. 1. However any heat exchanger with open passages and hardway finning would exhibit similar flow resistance in a conditioning or defrost operation.

Figure 2B:
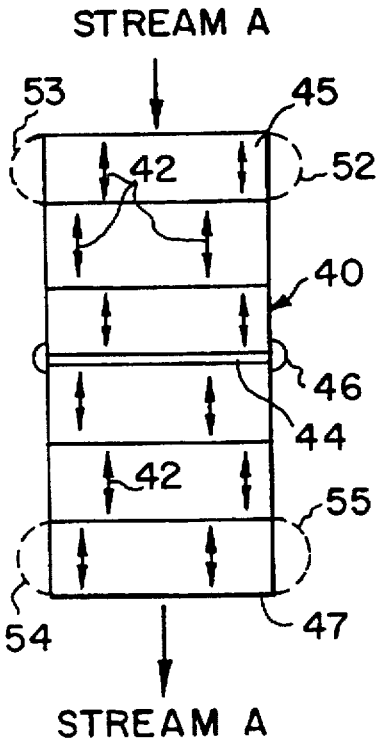
FIG. 2B is a section taken along line 2B—2B of FIG. 2A.
Figure 2A:
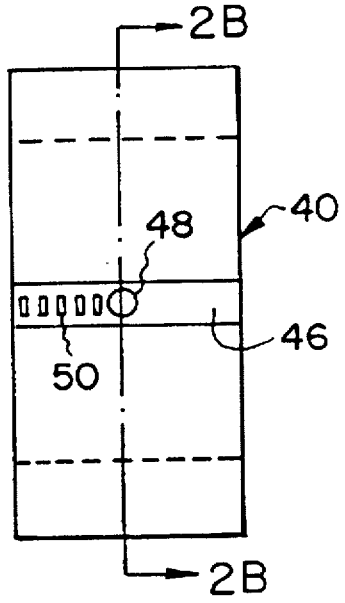
FIG. 2A is a schematic elevational view of an apparatus according to the present invention.
Figure 2C:
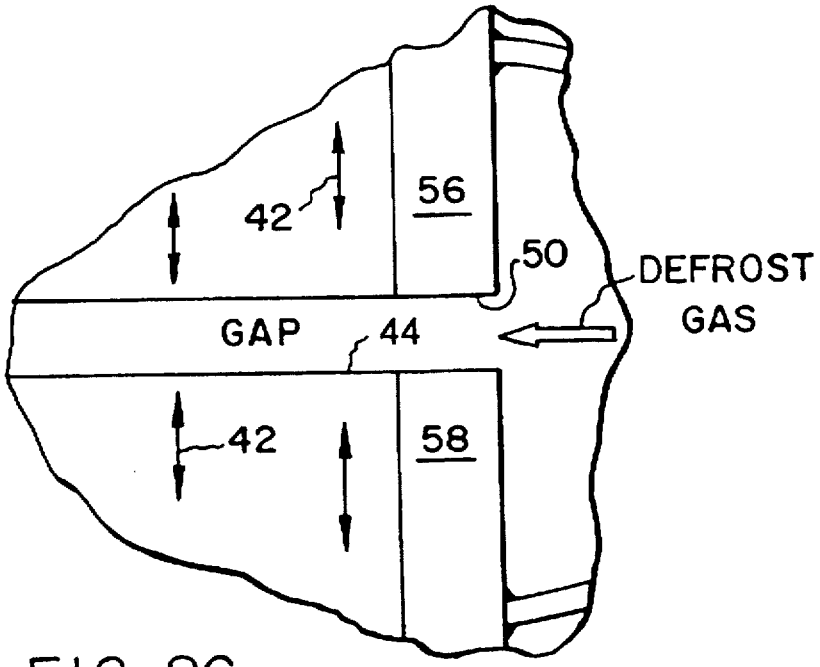
FIG. 2C is an enlarged fragmentary view of a portion of the heat exchanger of FIG. 2B.

FIGS. 2A through 2C illustrate application of the invention to a heat exchanger 40 having only easyway finning in the passages, the finning illustrated by the arrows 42 in FIG. 2B. An opening 44 and header 46 are included between the first end 45 and the second end 47 of the passages used to conduct a first stream (Stream A) through the heat exchanger 40. Opening 44 is connected to a header 46 for introducing the conditioning fluid into the heat exchanger. Opening 44 is preferably placed midway between the first end 45 and second end 47 of the passages adapted to receive Stream A and is in the form of a gap in the fins in what would otherwise be continuous passages. As shown in FIG. 2A, header 46 includes an inlet conduit 48 and a plurality of spaces or apertures 50 which are aligned with the passages used to conduct Stream A through the heat exchanger. Thus, a conditioning fluid, e.g., defrost gas, introduced into conduit 48 is conducted through apertures 50 into openings 44 and then moves vertically both upwardly and downwardly through the passages used to conduct Stream A through the heat exchanger to condition such passages. Other streams are introduced and removed from the heat exchanger 40 via headers 52 and 53, 54 and 55 as is well known in the art. As shown in FIG. 2C, spaces or apertures 50 are included in the side bars 56, 58 of the passages for Stream A. This may be in the form of spaces between side bars 56 and 58 or holes in a single side bar which would take the place of separate side bars 56 and 58.

Figure 3A:
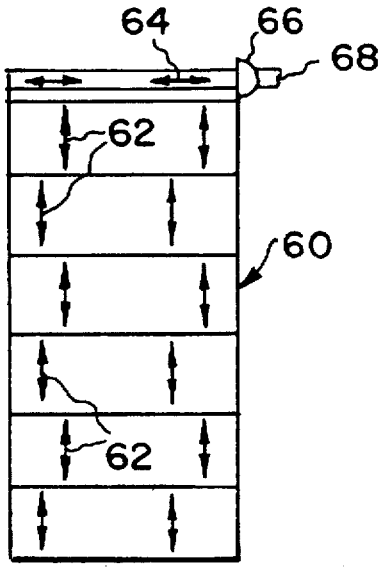
FIG. 3A is a schematic cross-sectional view of a heat exchanger having both hardway and easyway finning according to the present invention.
Figure 3C:
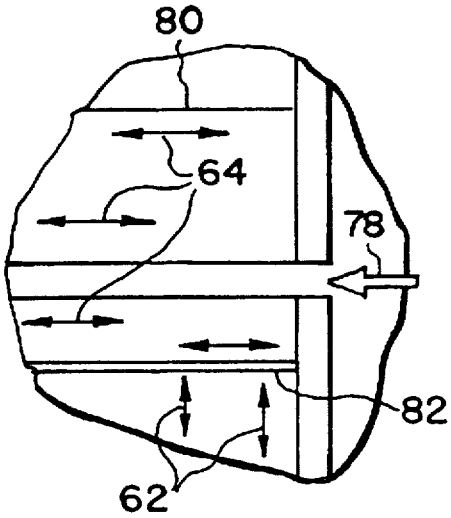
FIG. 3C is an enlarged fragmentary view of an alternate method of introducing the conditioning fluid into the heat exchanger of FIG. 3A.
Figure 3B:
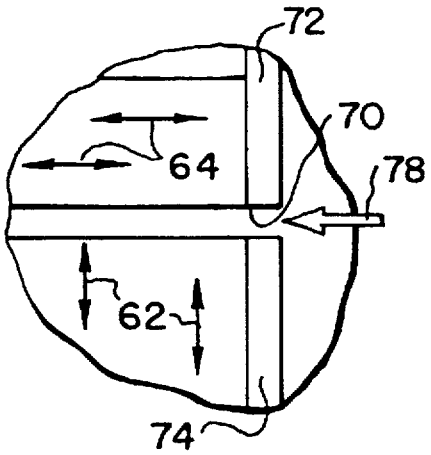
FIG. 3B is an enlarged fragmentary view of a portion of the heat exchanger of FIG. 3A illustrating introduction of the conditioning fluid.
Figure 3D:
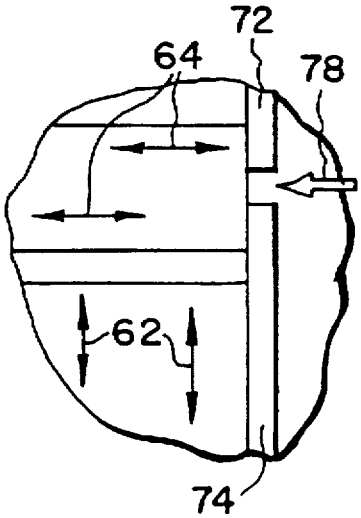
FIG. 3D is an enlarged fragmentary view of the heat exchanger of FIG. 3A showing a yet another method of introducing the conditioning fluid into the heat exchanger of FIG. 3A.

FIG. 3A shows a representative open-ended stream in a heat exchanger 60 having vertical passages containing easyway fins shown by arrows 62 and hardway fins shown by arrows 64. As shown in FIG. 3A, a header 66 having a conduit 68 is used to introduce a conditioning fluid into the hardway finned portion of the heat exchanger passages. As shown in FIG. 3B, the conditioning fluid can be introduced into the passages of a group of passages via a space or aperture 70 in side bars 72, 74 between the easyway fins 62 and the hardway fins 64, with the introduction of the fluid being shown by arrow 78. FIG. 3C shows a method of introducing the conditioning fluid in a location that is between the top 80 and the bottom 82 of the hardway fin 64 portion of the heat exchanger, the introduction of the fluid being shown by arrow 78. FIG. 3D shows a method of introducing the conditioning fluid shown by arrow 78 into the hardway fin 64 portion of the heat exchanger via apertures in the side bars 72, 74 directly into the hardway finning.

Figure 4A:
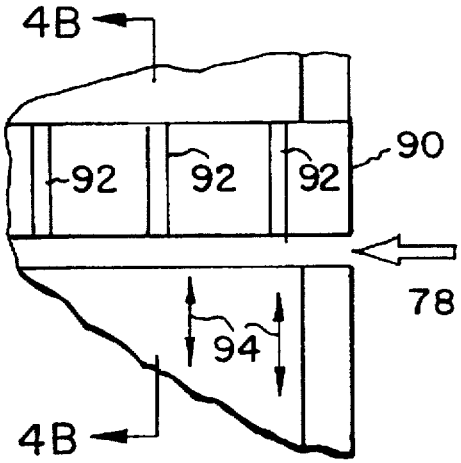
FIG. 4A is an enlarged fragmentary view of an apparatus for introducing conditioning fluid into a heat exchanger such as shown in FIG. 3A.
Figure 4B:
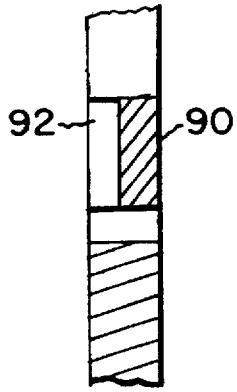
FIG. 4B is a view taken along line 4B—4B of FIG. 4A.

FIGS. 4A and 4B show a vertically slotted bar 90 having slots 92 for forcing conditioning fluid down into the passages of the heat exchanger containing finning shown generally by arrows 94.

Figure 4C:
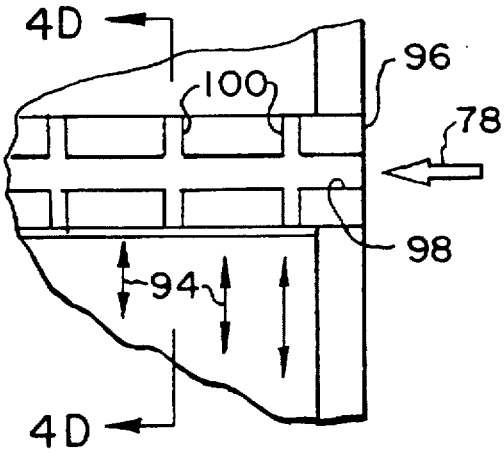
FIG. 4C is an enlarged fragmentary view of an apparatus for introducing conditioning fluid into the heat exchanger of FIG. 3A.
Figure 4D:
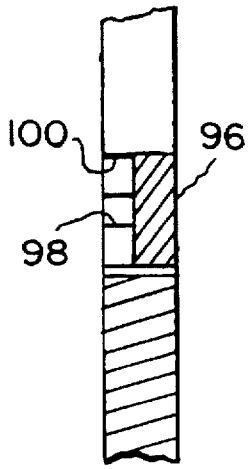
FIG. 4D is a view taken along line 4D—4D of FIG. 4C.

FIGS. 4C and 4D show the use of a bar 96 having a horizontal slot 98 and vertical slots 100 for introducing conditioning fluid into the passages of the heat exchanger containing finning shown generally by arrows 94. Although in FIGS. 4C and 4D horizontal slot 98 is shown symmetrically within bar 96, this horizontal slot may be asymmetricallyy positioned. Further, although vertical slots 100 are shown as all being of equal size (e.g., same width), these vertical slots can be of different sizings.

Figure 4E:
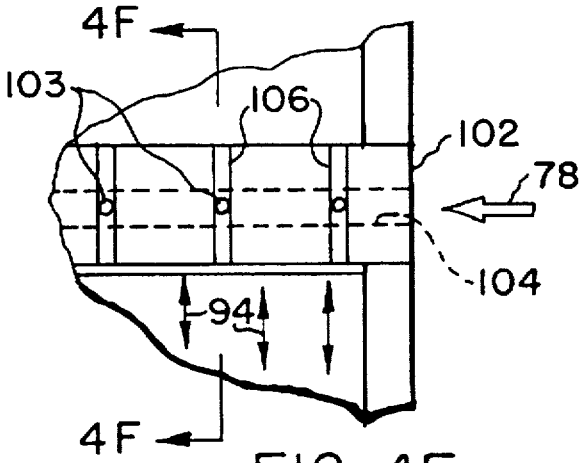
FIG. 4E is an enlarged fragmentary view of another method of introducing the conditioning fluid into the heat exchanger of FIG. 3A.
Figure 4F:
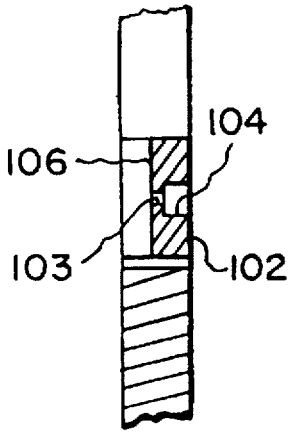
FIG. 4F is a view taken along line 4F—4F of FIG. 4E.

FIGS. 4E and F show the use of a bar 102 containing a horizontal slot 104 and vertical slots 106 for introducing conditioning gas shown by arrow 78 into the passages containing fins shown by arrows 94. Bar 102 includes apertures (holes) 103 in the vertical passages to help distribute the conditioning fluid from the horizontal slot into the vertical slots. Although in FIGS. 4C and 4D horizontal slot 104 is shown symmetrically within bar 102, this horizontal slot may be asymmetricallyy positioned. Further, although vertical slots 106 are shown as all being of equal size (e.g., same width), these vertical slots can be of different sizings.

Figure 5A:
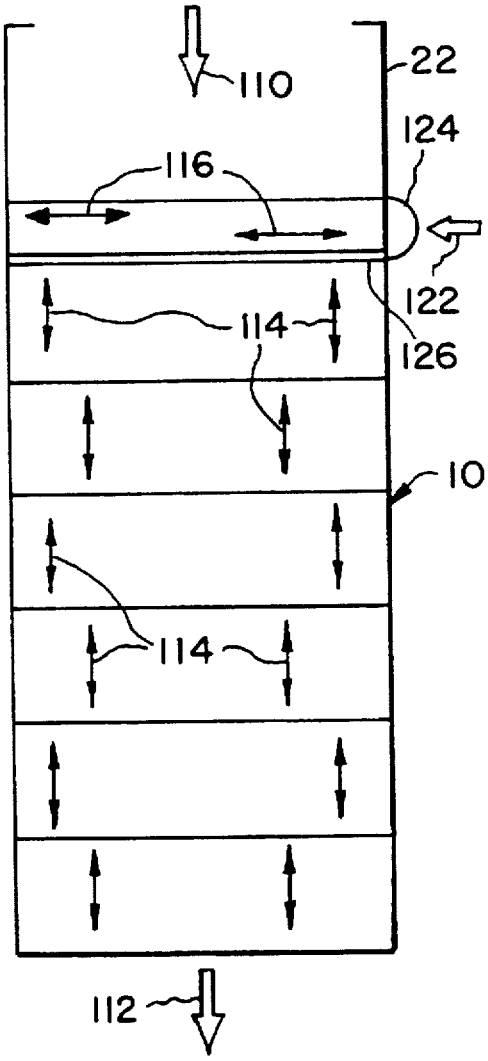
FIG. 5A is a schematic representation of the open stream passages of a heat exchanger used as a downflow reboiler illustrating an application of the present invention.
Figure 5B:
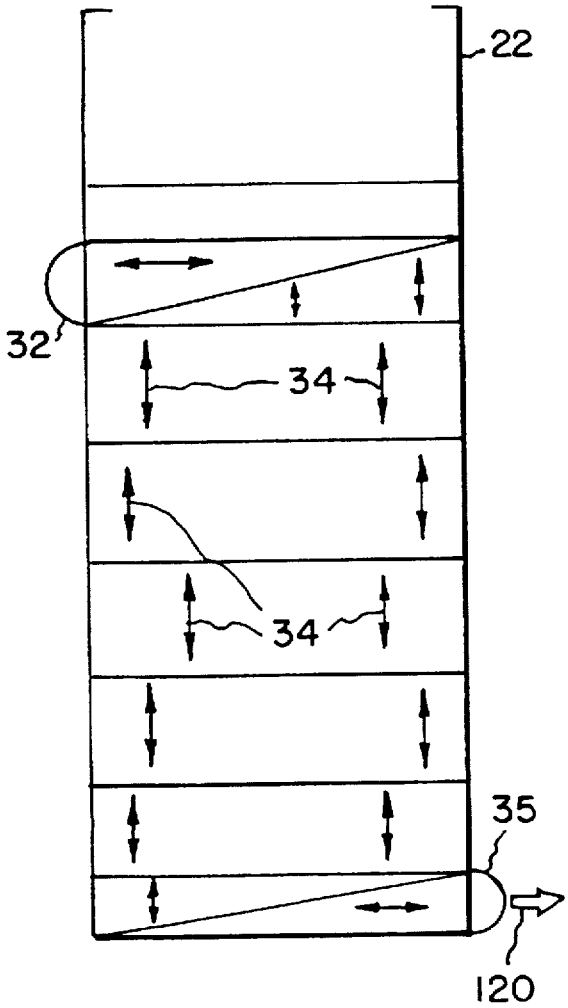
FIG. 5B is a schematic representation of the closed stream passages of a heat exchanger used as a downflow reboiler illustrating an application of the present invention.

FIG. 5A is a schematic representation of the device of FIG. 1 used as a downflow reboiler where a boiling/evaporating stream is introduced into the heat exchanger 10 via pan-like device 22 as shown by arrow 110. The boiling/evaporating stream is removed from the heat exchanger 10 as shown by arrow 112. The easyway fins are represented by arrows 114 and the hardway fins by arrows 116. As shown in FIG. 5B, the condensing stream is introduced into the heat exchanger through header (manifold) 32 and the condensed stream is removed from header 35 as shown by arrow 120. Arrows 34 represent the flow of condensing fluid. In the device of FIGS. 5A and 5B, the boiling/evaporating stream can be an oxygen-containing fluid and the condensing stream can be a nitrogen and/or argon containing fluid. Prior to putting the downflow reboiler into service, the entire unit should be defrosted. The present invention concerns defrosting only the boiling/evaporating stream passages which are open-ended. In order to do this, a defrost gas shown by arrow 122 is introduced into the defrost header 124 and into openings 126. Analogous to the illustration in FIG. 3B it can flow upwardly through the hardway fin portion of the passages and downwardly through the easyway fin portion of the passages to completely condition the downflow reboiler prior to use. Alternatively the defrost gas can be introduced into the heat exchanger in accordance with the method and apparatus of FIGS. 3C and 3D.

Figure 6A:
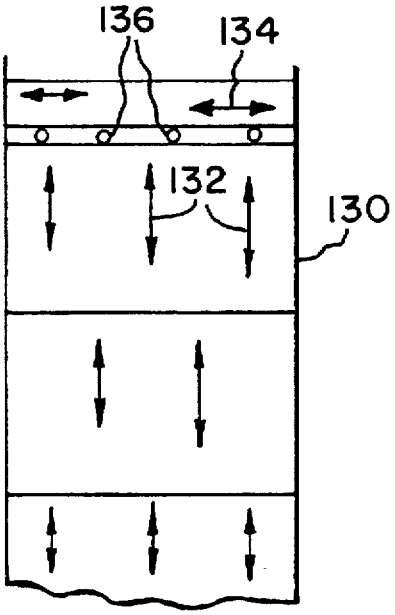
FIGS. 6A, 6B, 6C, and 6D are fragmenting schematic representations of a method of introducing a conditioning fluid through the parting sheets in a heat exchanger used as a downflow reboiler.
Figure 6B:
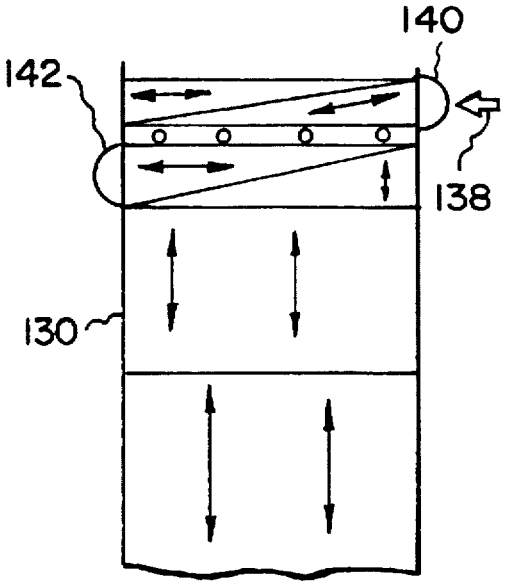
Figure 6C:
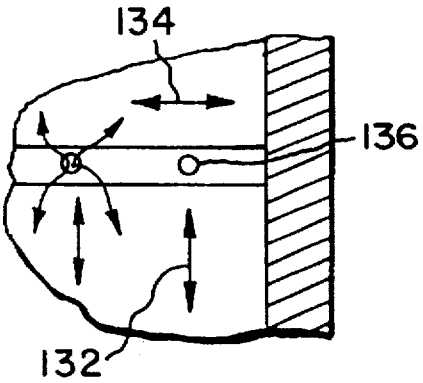
Figure 6D:
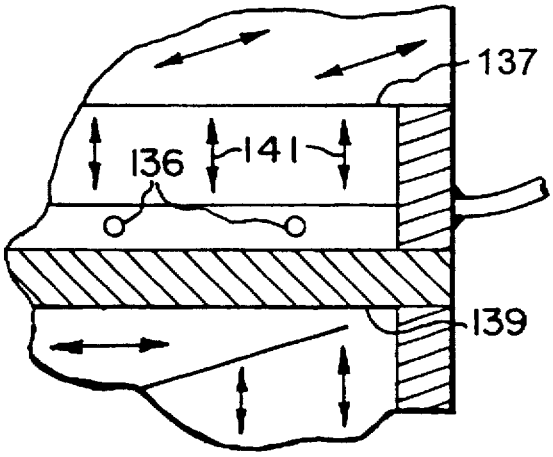
Figure 6E:
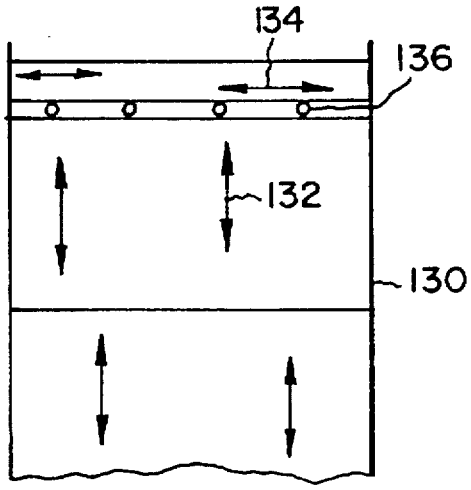
FIGS. 6E, 6F, 6G and 6H illustrate a method and apparatus for preventing leakage between the flow passages of the first and second fluid of a heat exchanger used as a downflow reboiler.
Figure 6F:
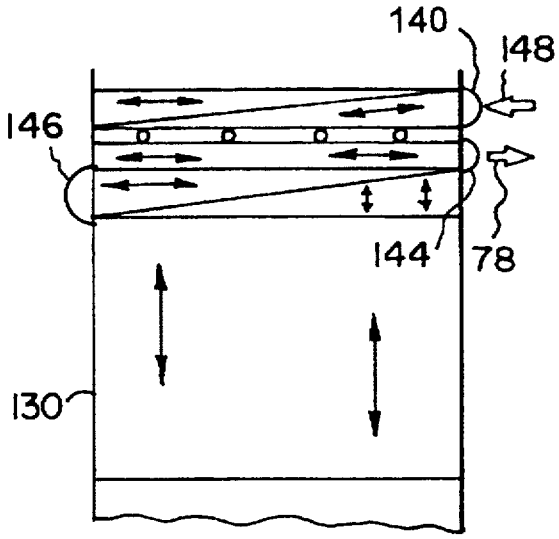
Figure 6G:
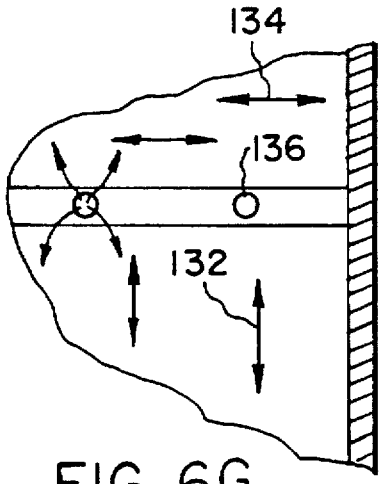
Figure 6H:
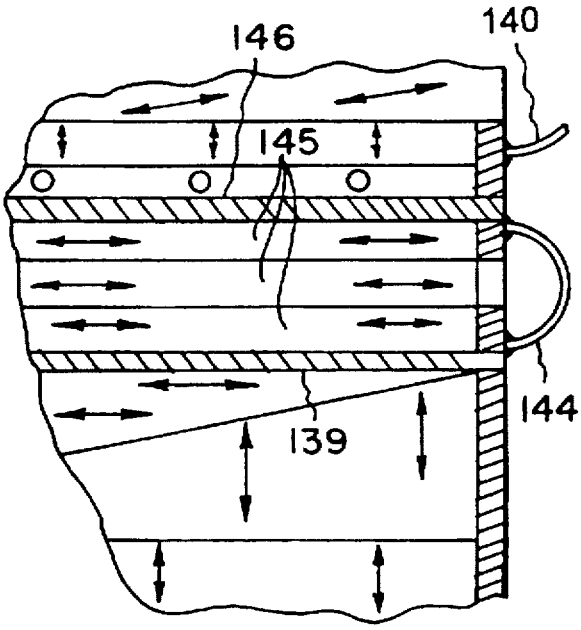

FIG. 6A, 6B, 6C and 6D illustrate a heat exchanger 130 of the type shown in FIG. 1 having an easyway fin portion represented by arrows 132 and a hardway fin portion represented by arrows 134 in the open-ended passages of the heat exchanger. In the heat exchanger, the open-ended passages shown in FIG. 6A and 6C are separated from the closed end passages shown in FIG. 6B and 6D by what are called parting sheets. In the apparatus of FIGS. 6A through 6D, the parting sheets in the section of the passages above the easyway fin portion of the heat exchanger are perforated with a series of apertures or holes 136 so that a conditioning fluid, shown by arrow 138, can be introduced into a header 140 which is placed above the header 142 which is used to introduce the second fluid into the heat exchanger 130. FIG. 6C illustrates in greater detail the apertures 136 which permit introducing of the conditioning gas into both the hardway and the easyway fin portions of the open passages of the heat exchanger adapted to receive the boiling/evaporating (first fluid). FIG. 6D illustrates the inclusion of defrost distributor fins 137 and 141 to aid in the distribution of the defrost gas coming in through header 140 and flowing through apertures 136 through both the hardway fins 134 and the easyway fin 132 portions of the open passage. In this embodiment defrost gas is introduced into the unused top end of at least one group of closed passages. During normal operation, streams in the open and closed passages are sealed against each other by end bar 139.

FIGS. 6E through 6H illustrate a method of separating the conditioning gas circuit from the second set of passages of the heat exchanger of FIGS. 6A through 6D. In the embodiment of FIGS. 6E through 6H, defrost gas manifold 140 functions in a manner 10 identical to the defrost gas manifold 140 shown in FIG. 6B, wherein the defrost gas is introduced into the heat exchanger via header 140. An additional header 144 with fin sections 145 placed between end bar 139 and end 146 serves to isolate the stream flowing in the open-ended passages from the other streams flowing in the heat exchanger by venting through header 144. This will vent leakage gas past bars 139 and 146 during normal operation.

Thus, according to the present invention, the introduction of a conditioning fluid into a group of open-ended passages of a plate fin type heat exchanger is dramatically enhanced.

For example, if a heat exchanger according to the present invention is used as a downflow reboiler, it is easy to condition the open-ended passages, especially those used for the boiling/evaporating fluid by introducing the conditioning fluid (defrost gas) into these passages.

The method and the apparatus according to the present invention results in design simplification and thus significant cost reduction in fabricating heat exchangers that must accommodate the introduction of a conditioning fluid into the heat exchanger with assurance that the conditioning fluid will reach all portions of the passages of the heat exchanger.

Thus, according to the present invention, the heat exchanger can be conditioned easily without disturbing the use of hardway finning to distribute liquid in a uniform manner into certain passages of the heat exchanger. Distribution of the conditioning fluid can be made through gaps and side bars used to close the heat exchanger passages or openings in parting sheets between the heat exchanger passages.

Having thus described our invention as recited and secured by Letters Patent of the United States as set forth in the appended claims.

We claim:

1. A heat exchanger of the type having a generally parallelpipedal body having disposed therein an assembly of parallel passages extending generally parallel to the longitudinal axis of said body wherein a first fluid is introduced via a first means for fluid introduction into a first group of open-ended passages and one or more fluids are introduced via a second means for fluid introduction into a separate group or groups of passages, the separate group or groups of passages alternate with a passage of said first group of passages, said second fluid or fluids introduced in parallel or countercurrent flow to the first fluid, wherein said open-ended passages each have two (2) or more sections of finning and wherein said finning functions to conduct the flow of the first fluid in said open-ended passages, the improvement comprising:

means to introduce a conditioning fluid selected from the group consisting of defrosting, drying, cleaning, and surface treating fluids via a third means for fluid introduction which is different from said first and second means for fluid introduction into said open-ended passages;

said means adapted to introduce said conditioning fluid at a first end of or a second end of, or between a first end of each of said open-ended passages and a second end of each of said passages without interference with the function of the finning in the open-ended passages; and means to recover conditioning fluid from said heat exchanger.

2. A heat exchange according to claim 1 said means to introduce said conditioning fluid is at a first end of said open-ended passages.

3. A heat exchanger according to claim 1 wherein said means to introduce said conditioning fluid is between said first and second ends of said open-ended passages.

4. A heat exchanger according to claim 1 wherein said means to introduce said conditioning fluid is at a second end of said open-ended passages.

5. A heat exchanger according to claim 1 wherein said heat exchanger includes a portion of hardway finning on top of a portion of easyway finning in said open-ended passages and said means to introduce said fluid is between said hardway and easyway finned sections of said heat exchanger.

6. A heat exchanger according to claim 1 wherein said open-ended passages include a portion of hardway finning and easyway finning and said means for introducing said conditioning fluid is between a first and second end of said hardway finned section.

7. A heat exchanger according to claim 1 wherein said open-ended passages include a portion of hardway finning and easyway finning and said means for introducing said conditioning fluid directly into said hardway finning.

8. A heat exchanger according to claim 1 wherein said heat exchanger includes a slotted bar portion on top of a portion of easy way finning in said open-ended passages and said means to introduce said fluid is in said slotted bar portion of said heat exchanger.

9. A heat exchanger according to claim 1 wherein said means to introduce conditioning fluid is at a first end of said heat exchanger and said means to recover said conditioning fluid is at a second end of said heat exchanger.

10. A heat exchanger according to claim 1 wherein said means to introduce said conditioning fluid includes additional means contained in parting sheets separating each passage of said first group of passages from an adjacent passage of said second group or groups of passages.

11. A downflow reboiler of the type having a generally parallelpipedal body having disposed therein an assembly of parallel passages extending generally parallel to the longitudinal axis of said body wherein a first fluid is introduced via a first means for fluid introduction into a first group of open-ended passages and one or more fluids are introduced via a second means for fluid introduction into a separate group or groups of passages, the separate group or groups of passages alternate with a passage of said first group of passages, said second fluid or fluids introduced in parallel flow to the first fluid, wherein said open-ended passages each have two (2) or more sections of finning and wherein said finning functions to conduct the flow of the first fluid in said open-ended passages, the improvement comprising:

means to introduce a conditioning fluid selected from the group consisting of defrosting, drying, cleaning, and surface treating fluids via a third means for fluid introduction which is different from said first and second means for fluid introduction into said open-ended passages;

said means adapted to introduce said conditioning fluid at a first end of, or a second end of, or between a first end of each of said open-ended passages and a second end of each of said passages without interference with the function of the finning in the open-ended passages; and means to recover conditioning fluid from said heat exchanger.

12. A downflow reboiler according to claim 11 wherein said means to introduce said conditioning fluid is at a first end of said open-ended passages.

13. A downflow reboiler according to claim 11 wherein said means to introduce said conditioning fluid is between said first and second ends of said open-ended passages.

14. A downflow reboiler according to claim 11 wherein said means to introduce said conditioning fluid is at a second end of said open-ended passages.

15. A downflow reboiler according to claim 11 wherein said heat exchanger includes a portion of hardway finning on top of a portion of easyway finning in said open-ended passages and said means to introduce said fluid is between said hardway and easyway finned sections of said heat exchanger.

16. A downflow reboiler according to claim 11 wherein said open-ended passages include a portion of hardway finning and easyway finning and said means for introducing said conditioning fluid is between a first and second end of said hardway finned section.

17. A downflow reboiler according to claim 11 wherein said open-ended passages include a portion of hardway finning and easyway finning and said means for introducing said conditioning fluid directly into said hardway finning.

18. A downflow reboiler according to claim 11 wherein said downflow reboiler includes a slotted bar portion on top of a portion of easy way finning in said open-ended passages and said means to introduce said fluid is in said slotted bar portion of said downflow reboiler.

19. A downflow reboiler according to claim 11 wherein said means to introduce conditioning fluid is at a first end of said downflow reboiler and said means to recover said conditioning fluid is at a second end of said downflow reboiler.

20. A downflow reboiler according to claim 11 wherein said means to introduce conditioning fluid includes additional means contained in parting sheets separating each passage of said first group of passages from an adjacent passage of said second group or groups of passages.

21. A downflow reboiler according to claim 20 installed in a column of an air separation plant wherein a liquid oxygen containing stream is passed through said open-ended passages in parallel flow to nitrogen and/or argon containing streams in said separate passages.

* * * * *

UNITED STATES PATENT AND TRADEMARK OFFICE

CERTIFICATE OF CORRECTION

PATENT NO. : 5,730,209

DATED : Mar. 24, 1998

INVENTOR(S) : Swaminathan Sunder et al.

It is certified that error appears in the above-identified patent and that said Letters Patent is hereby corrected as shown below:

Column 7, Line 18

After "1", insert --wherein--.

Signed and Sealed this

Nineteenth Day of May, 1998

Bruce Lehman

*Attest:*

BRUCE LEHMAN

*Attesting Officer*

*Commissioner of Patents and Trademarks*